United States Patent [19]

Bühler et al.

[11] Patent Number: 4,704,082

[45] Date of Patent: Nov. 3, 1987

[54] ISOSTATIC PRESS MOLD FOR PRODUCING MOLDINGS FROM CERAMIC MATERIAL

[75] Inventors: Eugen Bühler, Schleifweg 3, 8877 Burtenbach; Klaus Strobel; Karl Schwarzmeier, both of Selb, all of Fed. Rep. of Germany

[73] Assignees: Hutschenreuther AG, Selb; Eugen Bühler, Burtenbach, both of Fed. Rep. of Germany

[21] Appl. No.: 857,857

[22] Filed: Apr. 30, 1986

[30] Foreign Application Priority Data

May 14, 1985 [DE] Fed. Rep. of Germany ..... 3517463

[51] Int. Cl.[4] ..... B30B 5/02

[52] U.S. Cl. ..... 425/405 H; 264/56; 425/389; 425/406; 425/DIG. 19; 425/DIG. 44

[58] Field of Search ..... 249/65; 425/33, 40, 425/51, 405 R, 405 H, 406, 407, 411, 457, 383, 384, 389, 390, DIG. 14, DIG. 19, DIG. 44, DIG. 110, DIG. 112; 100/93 P, 211, 269 A; 264/56, 60, 64, 65, 66

[56] References Cited

U.S. PATENT DOCUMENTS

| | | | |
|---|---|---|---|
| 2,152,738 | 4/1939 | Jeffery | 425/405 H |
| 2,847,708 | 8/1958 | Hamjian et al. | 425/405 H |
| 3,594,877 | 7/1971 | Suda | 425/405 H |
| 3,897,532 | 7/1975 | Lyssy | 425/412 |
| 4,496,299 | 1/1985 | Pettersson | 425/DIG. 44 |

FOREIGN PATENT DOCUMENTS

| | | | |
|---|---|---|---|
| 2165280 | 8/1972 | Fed. Rep. of Germany | 425/405 H |
| 3101236 | 1/1982 | Fed. Rep. of Germany . | |
| 41-12152 | 7/1966 | Japan | 425/405 H |

*Primary Examiner*—Jay H. Woo
*Assistant Examiner*—J. Fortenberry
*Attorney, Agent, or Firm*—Toren, McGeady & Associates

[57] ABSTRACT

The invention concerns an isostatic press mold for producing moldings from powdery ceramic material. The mold comprises two mold parts which are movable relative to one another between a mold-closed position and a mold-open position and which, in the mold-closed position, define between them a mold cavity. On at least one of the mold parts, there is a press diaphragm which on one side defines part of the limiting surface of the mold cavity and on the other side is subjected to a pressure fluid. On its said other side, that is to say on its side facing away from the mold cavity, the press diaphragm is designed with a plurality of recess spaces so that the press mold can be deformed, while at the same time reducing the internal stresses occurring in it.

14 Claims, 6 Drawing Figures

ISOSTATIC PRESS MOLD FOR PRODUCING MOLDINGS FROM CERAMIC MATERIAL

BACKGROUND OF THE INVENTION

This invention relates to an isostatic press mold for producing moldings from ceramic material.

In German Patent Specification No. 3,101,236 there is disclosed an isostatic press mold comprising two mold parts which are movable relative to one another between a mold-closed position and a mold-open position and which, in the mold-closed position, define between them a mold cavity, there being, on at least one of the mold parts, a press diagraphm which on one side defines part of the limiting surfaces of the mold cavity and on the other side can be subjected to a pressure fluid, especially a pressure liquid.

In the known embodiment, the press diaphragm is relatively thin-walled. This thin-walled press diaphragm has hitherto been considered necessary because internal stresses in the elastomeric material of the press diaphragm can be kept within acceptable limits in this way. Excessive internal shearing stresses and compressive stresses in the press diaphragm must be avoided if the deformation behaviour of the press diaphragm during the pressing operation is to be controlled at all.

On the other hand, if the press diaphragm has a small wall thickness it is easy for the contours of the molding material which is being pressed by the press diaphragm to become blurred, because the press diaphragm, which is supported by an hydraulic pressure medium, behaves in a similar way to a "waterbed", that is to say it can be deformed in an indeterminable way.

The object of the present invention is therefore to provide an isostatic press mold such that, whilst excessive internal stresses within the press diaphragm are avoided, it is possible to produce clearly defined contours in the molding material by means of the surface of the press diaphragm facing the mold cavity.

SUMMARY OF THE INVENTION

According, therefore, to the present invention, there is provided an isostatic press mold for producing moldings from ceramic material, the said press mold comprising two mold parts which are movable relative to one another between a mold-closed position and a mold-open position and which, in the mold-closed position, define between them a mold cavity, there being, on at least one of the mold parts, a press diaphragm which on one side defines part of the limiting surface of the mold cavity and on the other side can be subjected to a pressure fluid, the press diaphragm being designed, on its said other side, with a plurality of recess spaces.

Because of the presence of the said recess spaces, undesirable stress states in the press diaphragm can be avoided. Moreover, it is possible to make the contours produced by the press diaphragm more definite, that is to say to reproduce these contours more accurately from one molding to another. It has also been shown that sharp contours, which cannot be produced with thin-walled diaphragms because they become "blurred", can be obtained when the press diaphragm is designed according to the invention, specifically because the wall thickness of the diaphragm can be made very much greater than hitherto, without the feared undesirable stress states occurring when pressure is exerted.

The recess spaces can, if desired, be accessible to the pressure fluid. This is not essential, however. Thus it is also possible for the recess spaces to be covered by a covering diaphragm which rests against the other side of the press diaphragm, that is to say against the side facing away from the mold cavity, so that no pressure fluid can penetrate into the recess spaces.

In general, good results as regards reproducible profiles of the molding are obtained by means of the press diaphragm if the ends of the recess spaces facing the mold cavity lie on an enveloping surface which is spaced by a substantially constant distance from the said limiting surface.

The distribution of the recess spaces over the press diaphragm can be determined empirically so that the molding within the mold cavity acquires a predetermined surface shape by means of the press diaphragm. As regards the arrangement of the recess spaces, it is possible to ensure that, wherever profile changes on the molding surface to be formed by the press diaphragm are to be expected, there is a strong concentration of recess spaces, and specifically the recess spaces should, as far as possible, extend there with their long axes parallel to the direction of the profile change. If this design stipulation is adhered to, it is possible, at the location of a high concentration of recess spaces, for the material of the press diaphragm on both sides of this region to shift relative to one another, thereby avoiding high internal stresses. Apart from this, of course, the concentration of recess spaces must be in proportion to the wall-thickness distribution of the press diaphragm.

In an isostatic press mold for producing dish-shaped moldings, in particular dish-shaped crockery articles, such as plates, bowls or dishes, in which in the mold-closed position, the mold parts are arranged adjacent to one another in the relative direction of movement, and the press diaphragm extends substantially transversely to the relative direction of movement, it has proved advantageous if the recess spaces are formed by channels which are substantially parallel to the relative direction of movement.

On the other hand, in isostatic press molds for producing tubular moldings, in which, in the mold-closed position, the mold parts are arranged substantially radially with respect to one another in relation to the relative direction of movement, and the press diaphragm is tubular and is arranged radially between the mold parts, it has proved advantageous if the recess spaces are bores which extend substantially radially.

The diaphragm may consist of an elastomeric material with a Shore hardness of approximately 80 to 92. The wall thickness of the diaphragm, perpendicular to the said limiting surface, may be at least approximately 20%, preferably at least approximately 50%, of the linear extent of the mold cavity perpendicular to the said limiting surface.

The distance in the relative direction of movement between the enveloping surface and the said limiting surface should preferably be at most 50% of the diaphragm wall thickness measured in the relative direction of movement.

DESCRIPTION OF THE DRAWINGS

The invention is illustrated, merely by way of example in the accompanying drawings, in which.

Terms such as "left" and "right", as used in the present specification, are to be understood to refer to directions as seen in the accompanying drawings.

DESCRIPTION OF THE PREFERRED EMBODIMENTS

Figure 1:
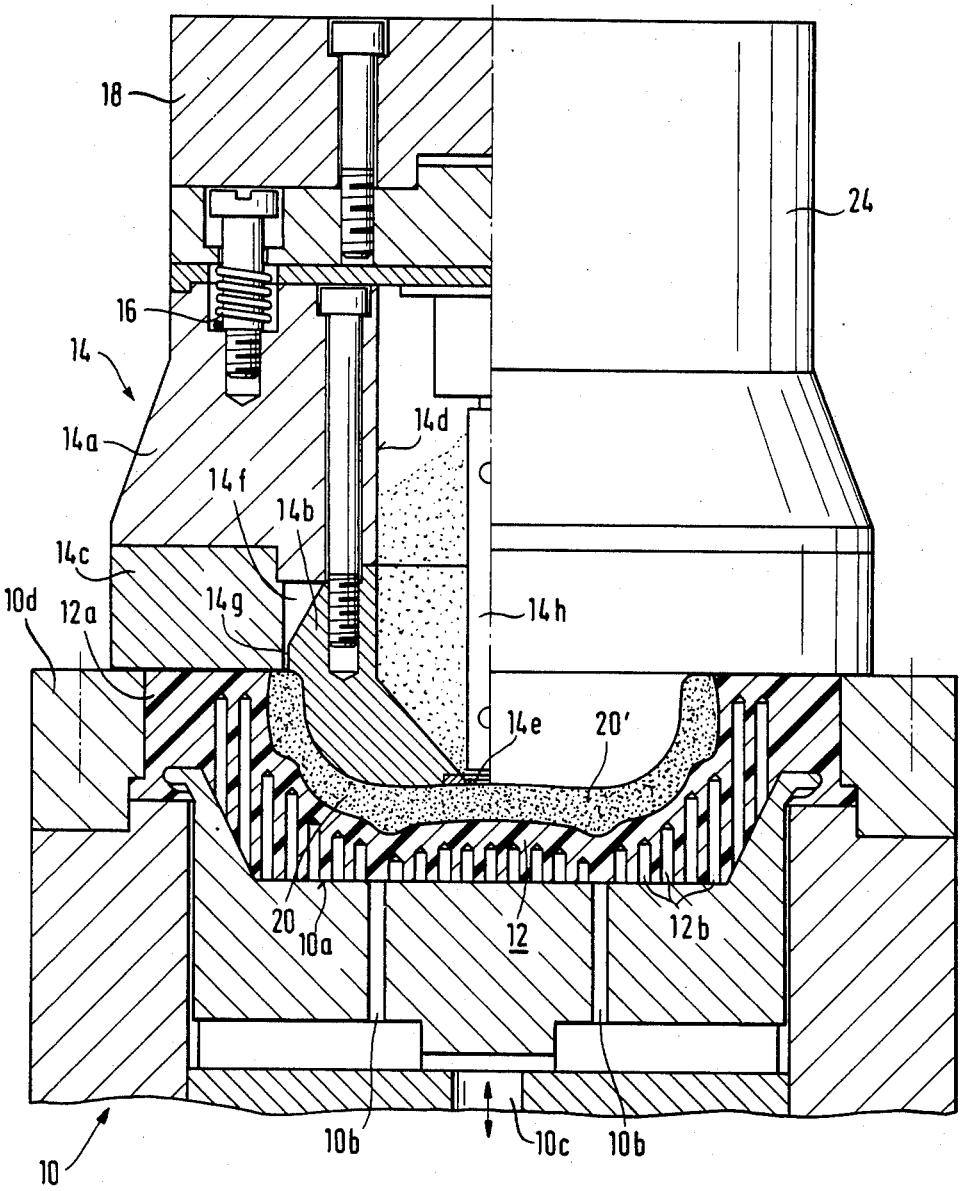
FIG. 1 shows a first embodiment of an isostatic press mold according to the invention, the press mold having a lower mold part (isostatic mold part), an upper mold part (left-hand half) designed as a shooting head and an upper mold part (right-hand half) designed as a press head.
Figure 2:
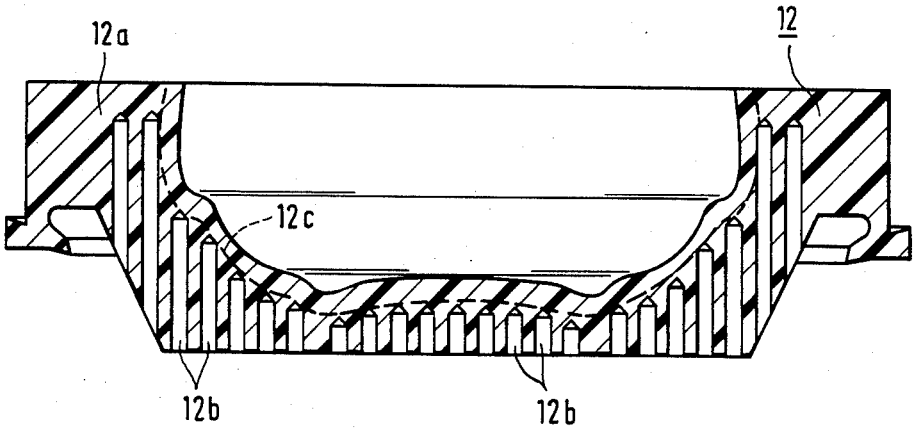
FIG. 2 shows, as a detail, a sectional view of a press diaphragm employed in the press mold of FIG. 1.
Figure 3:
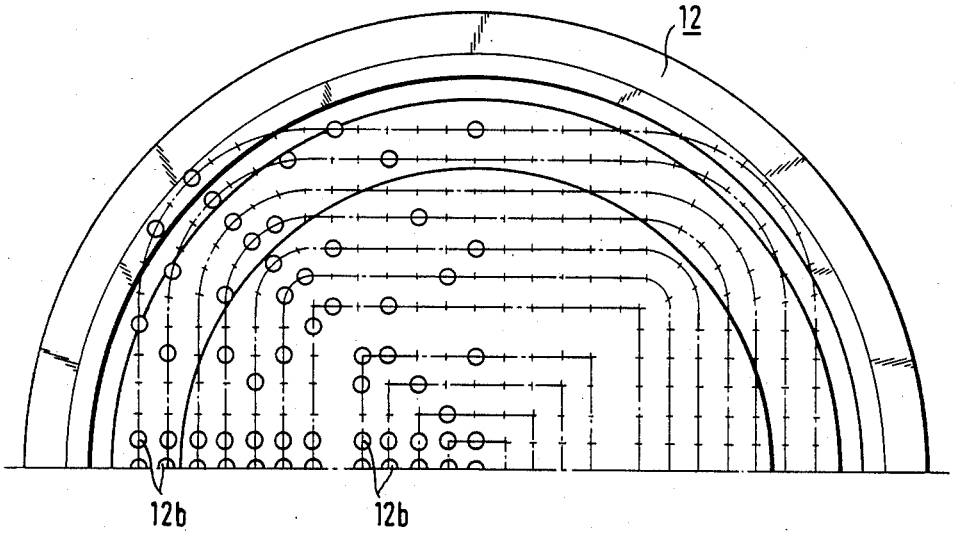
FIG. 3 shows a bottom view of the press diaphragm shown in FIGS. 1 and 2.

Referring first to FIGS. 1–3, an isostatic press mold according to the present invention for producing moldings from precompressed particulate ceramic material comprises a lower mold part 10. The lower mold part 10 is attached in a stationary manner to the frame (not shown) of a molding press. The lower mold part 10 has a pressure chamber 10*a* in which is disposed a press diaphragm 12. The pressure chamber 10*a* is connected to a pressure-liquid connection lO*c* via a multiplicity of channels 10*b*. The diaphragm 12 is fastened at one sealing edge 12*a* to the lower mold part 10 by means of a fastening flange lO*d*.

The left-hand half of FIG. 1 shows a shooting head 14 consisting of a main body 14*a*, a central mold body 14*b* and a gasket bearing ring 14*c*. The shooting head 14 is suspended on a vertically guided yoke 18 of the press by means of a multiplicity of helical compression springs 16.

A molding material chamber 14*d*, which has a feed orifice 14*e* at its bottom end, is formed centrally within the main body 14*a* and the central mold body 14*b* of the shooting head 14. The feed orifice 14*e* leads into a mold cavity 20 which is formed between the press diaphragm 12 and the central mold body 14*b* of the shooting head 14.

An annular chamber 14*f*, formed by the main body 14*a*, the central mold body 14*b* and the gasket bearing ring 14*c* of the shooting head 14*a*, is connected to a vacuum source and, via a suction orifice in the form of an annular gap 14*g*, is connected to the mold cavity 20.

A preform is formed in the mold cavity 20 between the lower mold part 10 and the shooting head 14, specifically because air is sucked out of the mold cavity 20 through the suction orifice constituted by the annular gap 14*g*, and consequently particulate ceramic molding material, for example spray-dried porcelain grains, is sucked into the mold cavity 20 through the feed orifice 14*e*. The distribution of the molding material in the mold cavity can be assisted by introducing fluidizing air by means of a fluidizing-air feed pipe 14*h*.

When the mold cavity 20 has been filled in this way, the suction is switched off and the shooting head 14 is lifted off by means of the yoke 18, and, via the helical compression springs 16, the sealing pressure between the sealing edge 12*a* and the gasket bearing ring 14*c* is slowly reduced. A pressure balance between the atmosphere and, if appropriate, the vacuum still prevailing in the mold cavity 20 is obtained in this way.

Subsequently, the shooting head 14 is lifted off completely in the vertical direction and then swung out sideways, whereupon a press head 24 is brought in line with the lower mold part 10 (right-hand half of FIG. 1) and pressed against the lower mold part. The isostatic pressing of the prepressed molding material remaining on the press diaphragm 12 can now take place. For this purpose, pressure liquid is introduced into the pressure chamber 10*a*, so that the press diaphragm 12 is pressed upwards.

As is evident from FIG. 2, the press diaphragm 12 is designed with a plurality of recess spaces 12*b* which extend into the press diaphragm 12, starting from its underside, in the direction of the mold-closing and mold-opening movement of the lower mold part 10, on the one hand, and of the press head 24, on the other hand, and which are open at the bottom. When the hydraulic pressure chamber 10*a* is filled, these recess spaces 12*b* are filled with pressure liquid.

The mold cavity 20' between the press diaphragm 12 and the press head 24 is adjusted to produce a dish-shaped molding with a rectangular contour, as shown in FIG. 3. FIG. 3 also shows the distribution of the recess spaces 12*b* over the horizontal projection of the press diaphragm 12. As is evident from FIG. 2, the recess spaces 12*b* end in an enveloping surface or plane 12*c* which, as FIG. 2 shows, is approximately equidistant from and generally conforms to the limiting surface of the press diaphragm 12 which faces the mold cavity 20 or 20'.

FIG. 1 reveals the relatively large wall thickness of the press diaphragm 12 in comparison with the clear width of the mold cavity 20 or 20'. For example, the wall thickness of the press diaphragm 12 in the center of the mold cavity 20 or 20' is greater than the clear height of the mold cavity 20, as measured in the same direction. It can also be seen that the distance between the enveloping surface or plane 12*c* according to FIG. 2 and the surface of the press diaphragm 12 facing the mold cavity is less than half the particular wall thickness of the press diaphragm.

As a result of the recess spaces 12*b*, the press diaphragm 12 is relatively flexible in relation to shearing stresses in the vertical direction (with reference to FIGS. 1 and 2). By concentrating recess spaces 12*b* in specific regions or along specific lines, it is possible to produce regions in which only slight shearing stresses occur, even when the diaphragm undergoes varying deformation in the vertical direction.

Figure 4:
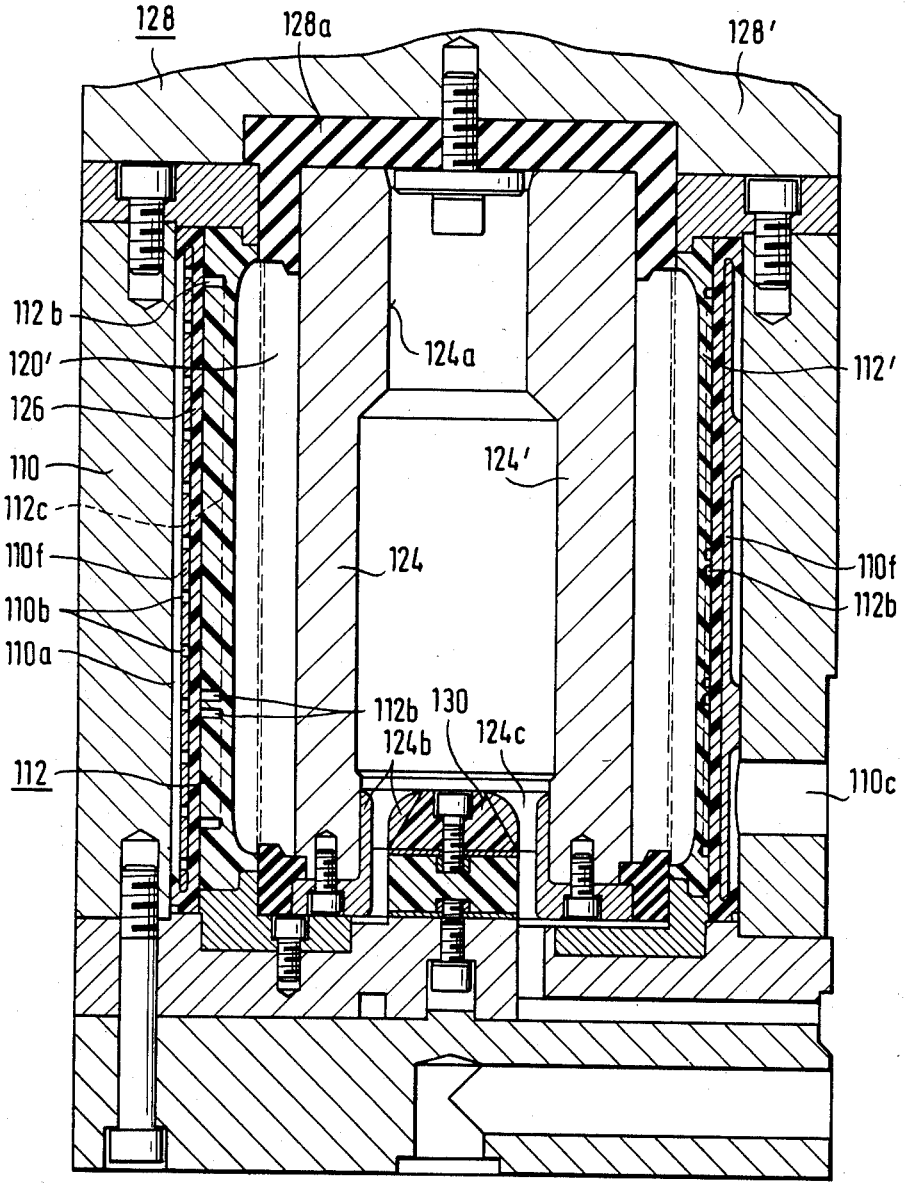
FIG. 4 shows, in section, a second embodiment of an isostatic press mold according to the present invention, the press mold of FIG. 4 being adapted to produce tubular moldings.

In FIG. 4, there is shown a further embodiment of an isostatic press mold according to the present invention having an outer mold part 110 and a core mold part 124. A hydraulic pressure chamber 110*a* is formed in the outer mold part 110 by means of a rigid tube 11O*f* with perforations 110*b* and is connected to a pressure generator (not shown) via a line 110*c*.

A covering diaphragm 126 rests against the inside of the rigid tube 110*f*, and there is a press diaphragm 112 which rests against the radially inner face of this covering diaphragm 126. The press diaphragm 112 defines, together with the core mold part 124, an annular mold cavity 120'.

The mold cavity 120' is covered by a cover 128 with a cover gasket 128*a*. When the cover 128 is removed, the mold cavity 120 is filled with ceramic particulate material and then compacted by the insertion of a vibrating cylinder into a central cavity 124*a* of the core mold part 124. The cover 128, together with the cover gasket 128*a*, is thereupon put in place. High-pressure liquid can now be introduced into the hydraulic pressure chamber 110*a* through the pressure line 110*c*, as a result of which the covering diaphragm 126 and the press diaphragm 112 are pressed radially inwardly. The ceramic molding material previously distributed over the entire mold cavity 120 is thereby pressed radially inwards past the double broken line. The cover 128, together with the cover gasket 128*a*, can now be removed, and the core mold part 124 can be pulled out of the outer mold part 110 by means of a grab (not shown). At the same time, the tubular molding is picked up together with the core mold part 124 and can then be stripped off from the core mold part 124.

The core mold part 124 is provided, at its bottom end, with a central guide bush 124*b*, through which pass channels 124*c* of no interest here. By means of this guide bush 124*b*. the core moulded part 124 is supported electrically in the axial and radial directions on an elastic centering pin 130. This elastic support is provided in order to ensure that the vibratory oscillations generated to vibrate the molding material are not transmitted to the apparatus as a whole.

Figure 5:
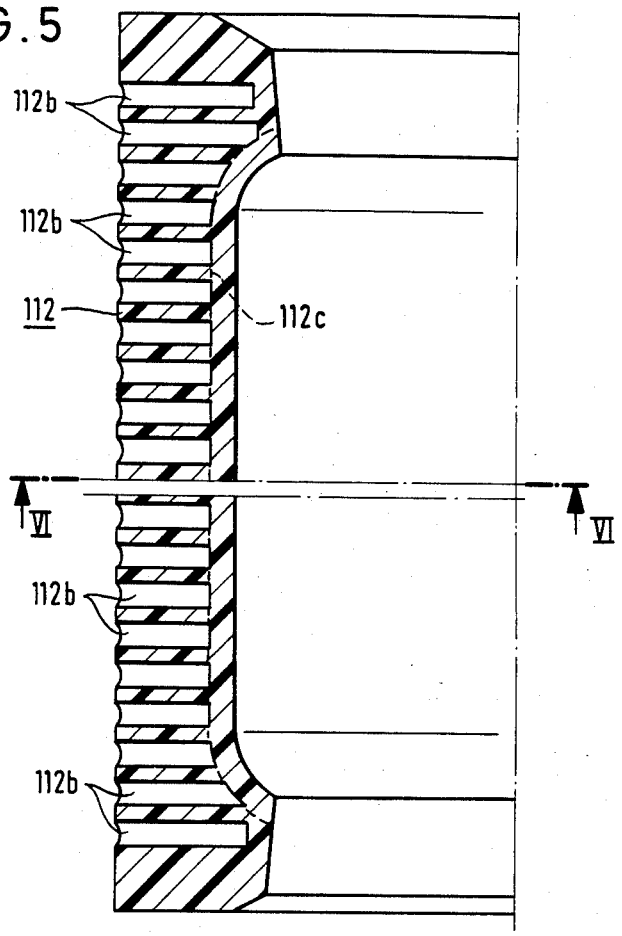
FIG. 5 is a longitudinal section through a press diaphragm forming part of the press mold of FIG. 4.
Figure 6:
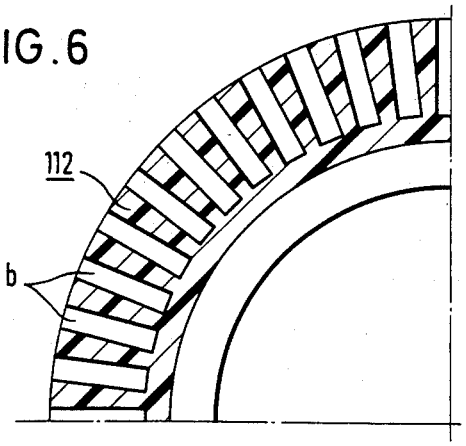
FIG. 6 is a section along the line VI—VI of FIG. 5.

As can be seen from FIG. 4 and especially from FIGS. 5 and 6, the press diaphragm 112 is provided with recess spaces 112*b* in the form of radial channels which are open at their radially outward ends and which end radially inwardly in an enveloping surface 112*c* (FIG. 5).

The right-hand half of FIG. 4 shows an embodiment intended for moldings of other dimensions, only the central mold part 124' with accessories, the press diaphragm 112' with accessories and the cover 128' with accessories having been replaced.

The effect of the recess spaces 112*b* is the same in the embodiment according to FIGS. 4 to 6 as in the embodiment according to FIGS. 1 to 3.

Further details relating to an isostatic tube press according to the present invention may be obtained from German Patent Specification No. 2,825,611.

Further details regarding ceramic molding materials suitable for use in the présent invention and regarding the introduction of the ceramic molding materials into the mold cavities under a vacuum may be obtained from German Patent Specification No. 3,101,236.

What is claimed is:

1. An isostatic press mold device for the production of dish shaped moldings having an outer face with a bottom portion and an inner face, said press mold device comprising two opposite mold units, a first mold unit having a first mold face corresponding to said outer face of said dish shaped molding, a second mold unit having a second mold face corresponding to said inner face of said dish shaped molding, said first and said second mold faces defining a mold cavity between them for receiving a charge of moldable, particulate, ceramic material, said first mold unit and said second mold unit being movable towards and away from each other in a moving direction perpendicular to said bottom portion between a mold cavity closed position and a mold cavity open position, at least said first mold face comprising an elastomeric press diaphragm of said first mold unit, said elastomeric press diaphragm having a peripheral edge zone sealingly fixed to said first mold unit, a back face of said elastomeric press diaphragm being exposed to a hydraulic pressure chamber within said first mold unit, said back face having a projectional surface area with two projectional surface axes perpendicular with respect to each other, said press diaphragm being provided with a plurality of channels substantially parallel with said moving direction, said channels opening into said back face and having closed ends adjacent said first mold face, said plurality of channels comprising more than five channels along each of said projectional surface area axes, said channels, having a cross-sectional area substantially invariable along the length of said channels, said cross-sectional area having two cross-sectional area axes perpendicular to each other, said cross-sectional area axes having substantially equal lengths.

2. An isostatic press mold device as set forth in claim 1, wherein said channels being accessible to pressure fluid within said hydraulic pressure chamber.

3. An isostatic press mold device as claimed in claim 1, wherein said back face is covered by a covering diaphragm which closes said channels.

4. An isostatic press mold device as set forth in claim 1, wherein said closed ends lie in a plane within said press diaphragm generally conforming to said first mold face and said plane is spaced by a substantially constant distance from said first mold face.

5. An isostatic press mold device as set forth in claim 1, wherein said elastomeric material having a Shore hardness substantially in the range of 90 to 92.

6. An isostatic press mold device as set forth in claim 1, wherein the wall-thickness of said press diaphragm in the said moving direction is at least 20% of the height of said mold cavity in said moving direction prior to the application of pressure.

7. An isostatic press mold device as set forth in claim 1, wherein said channels having a circular cross-section.

8. An isostatic press mold device for the production of tubular moldings having a radially outer face and a radially inner face, said press mold device comprising at least two mold units namely a core mold unit with a core mold face corresponding to said radially inner face and a peripheral mold unit with a peripheral mold face, corresponding to said radially outer face, said core mold face and said peripheral mold face defining a mold cavity between them for receiving a charge of moldable, particulate, ceramic material, at least one of said core mold face and said peripheral mold face comprising an elastomeric tubular press diaphragm of the respective mold unit, said tubular elastomeric press diaphragm being sealingly fixed at the ends thereof to the respective mold unit, a back face of said tubular elastomeric press diaphragm being exposed to a hydraulic pressure chamber within the respective mold unit, said tubular press diaphragm being provided with a plurality of radially extending channels, said channels opening into said back face and having losed ends adjacent said at least one mold face, said plurality of channels comprising more than five channels along a line parallel to the axis of said tubular elastomeric press diaphragm and comprising more than 20 channels along a circumferential peripheral line of said elastomeric tubular press diaphragm, said channels having a cross-sectional area substantially invariable along the length of said channels, said cross-sectional area having two cross-sectional area axis perpendicular to each other, said cross-sectional axis having substantially equal lengths.

9. An isostatic press mold device as set forth in claim 16, wherein said channels being accessible to a pressure fluid within said hydraulic pressure chamber.

10. An isostatic press mold device as set forth in claim 8, wherein said back face is covered by a covering diaphragm which rests against said back face of said tubular elastomeric press diaphragm.

11. An isostatic press mold device as set forth in claim 8, wherein said closed ends of said channels lying in a plane within said press diaphragm generally conforming to said at least one mold face and said plane is spaced by a substantially constant distance from said at least one mold face.

12. An isostatic press mold device as set forth in claim 8, wherein the tubular elastomeric press diaphragm has a Shore hardness substantially in the range of 80 to 92.

13. An isostatic press mold device as set forth in claim 8, wherein the radial wall thickness of said tubular elastomeric press diaphragm is at least substantially 20% of the radial height of the mold cavity prior to the application of pressure.

14. An isostatic press mold device as set forth in claim 8, wherein said channels having a circular cross-sectional area.

* * * * *